US005980287A

United States Patent [19]

Sasaki

[11] Patent Number: 5,980,287

[45] Date of Patent: Nov. 9, 1999

[54] ROTARY CONNECTOR

[75] Inventor: Kunihiko Sasaki, Miyagi-ken, Japan

[73] Assignee: Alps Electric Co., Ltd., Japan

[21] Appl. No.: 09/094,041

[22] Filed: Jun. 9, 1998

[30] Foreign Application Priority Data

Jun. 9, 1997 [JP] Japan ..... 9-151115

[51] Int. Cl.[6] ..... H01R 35/04

[52] U.S. Cl. ..... 439/164; 439/15

[58] Field of Search ..... 439/164, 15

[56] References Cited

U.S. PATENT DOCUMENTS 3,763,455 10/1973 Confer et al. .

5,413,492 5/1995 Obata ..... 439/164

5,882,216 3/1999 Matsumoto et al. ..... 439/164

*Primary Examiner*—Gary F. Paumen

*Attorney, Agent, or Firm*—Brinks Hofer Gilson & Lione

[57] ABSTRACT

A rotary connector using a plurality of flat cables in which buckling of the flat cable is prevented is disclosed. In a space defined between a fixed housing having an outer cylindrical wall and a movable housing having an inner cylindrical wall, two flat cables having reverse parts in the middle are overlapped and wound, and both ends of each of the flat cables are gathered at a fixed side joint on the outer cylindrical wall and a movable side joint on the inner cylindrical wall. Each of the first and second flat cables is a band-shaped body in which a plurality of conductors are laminated between a pair of base films. By performing a surface roughening process to the surface of one of the base films, a rough face having the central line average roughness Ra of 0.03 μm or larger is formed. The flat cables are overlapped so that the rough surface comes into contact with the flat face of the other cable.

13 Claims, 2 Drawing Sheets

ROTARY CONNECTOR

BACKGROUND OF THE INVENTION

The present invention relates to a rotary connector which is assembled in a steering system of a vehicle and used as electric connecting means of an air bag system or the like. More particularly, the invention relates to a rotary connector in which a flat cable is wound in the opposite direction via a reversing part in an annular space defined between a pair of housings.

In a rotary connector, a movable housing is rotatably connected to a fixed housing and a flat cable is housed and wound in an annular space defined between the housings. The rotary connector is used as electric connecting means of an air bag inflator or the like attached to a steering wheel having a limited number of rotation. The flat cable has a band-shaped member holding a conductor on a base film. Two types of a flat cable wound like a spiral and a flat cable reversely wound halfway are known. The required length of a flat cable of the latter reverse type can be made much shorter.

In the rotary connector of the reverse type, usually one flat cable is used. When the number of conductors increases as the number of circuits increases, the flat cable is widened in accordance with the number of conductors, so that reduction in the thickness of the whole rotary connector is disturbed. On the contrary, according to the rotary connector disclosed in the specification of U.S. Pat. No. 3,763,455, the conductors are apportioned to two flat cables, thereby dealing with the increase in the number of circuits.

FIG. 4 is a plan view showing a schematic construction of the rotary connector disclosed in the above specification of the patent. As shown in the diagram, a movable housing 101 having an inner cylindrical wall is rotatably attached to a fixed housing 100 having an outer cylindrical wall. A first flat cable 103 and a second flat cable 104 are housed in an annular space 102 defined between the fixed housing 100 and the movable housing 101. The flat cables 103 and 104 are housed in the space 102 on the outer cylindrical wall of the fixed housing 100 and on the inner cylindrical wall of the movable housing 101 so as to be wound in different directions. At the positions where the winding directions are reversed, U-letter shaped reverse parts 103*a* and 104*a* are formed. Inner ends of the flat cables 103 and 104 are connected to cable leading parts 107 and 108 which are arranged close to each other on the inner cylindrical wall of the movable housing 101 and are led to the outside of the movable housing 101 via the cable leading parts 107 and 108. On the other hand, the outer ends of the flat cables 103 and 104 are connected to cable leading parts 109 and 110 which are arranged close to each other on the outer cylindrical wall of the fixed housing 100 and are led to the outside of the fixed housing 100 via the cable leading parts 109 and 110. Further, groups 105 and 106 of a plurality of rollers are arranged in the radial direction in the space 102. The reverse part 103*a* of the first flat cable 103 is looped about one of the group 105 of rollers. The reverse part 104*a* of the second flat cable 104 is looped about one of the other group 106 of rollers.

In the rotary connector having the above construction, for example, when the movable housing 101 is rotated in the clockwise direction of FIG. 4, the reverse parts 103*a* and 104*a* of the flat cables 103 and 104 move in the clockwise direction in the space 102 by a rotation amount smaller than that of the movable housing 101. The flat cables 103 and 104 are in the winding state where the winding amount on the inner cylindrical wall of the movable housing 101 is larger. On the contrary, when the movable housing 101 is rotated in the counterclockwise direction, the reverse parts 103*a* and 104*a* of the flat cables 103 and 104 move in the same direction by a rotation amount smaller than that of the movable housing 101. The flat cables 103 and 104 are in the rewinding state where the winding amount on the outer cylindrical wall of the fixed housing is larger. In events of the winding and rewinding, the rollers 105 and 106 receive forces from the reverse parts 103*a* and 104*a* of the flat cables 103 and 104 and move in the same direction.

In the rotary connector using the overlapped flat cables 103 and 104 as the foregoing conventional example, although the first cable 103 is directly wound on the inner cylindrical wall of the movable housing 101, the second flat cable 104 is wound on the outside of the first flat cable 103 which has been wound on the inner cylindrical wall by one turn. Consequently, the diameters of the wound flat cables 103 and 104 on the inner cylindrical wall have the difference corresponding to the thickness of the first flat cable 103. The winding amounts on the inner cylindrical wall or the rewinding amounts from the inner cylindrical wall of the flat cables 103 and 104 are not strictly the same. When the movable housing 101 is rotated, a phenomenon such that the flat cables 103 and 104 are slid and deviated in the winding direction on their contact faces occurs. In this case, since the flat cables 103 and 104 are respectively energized to the outer and inner cylindrical wall sides by reaction forces from the reverse parts 103*a* and 104*a*, there is a problem such that the sliding friction when deviation occurs becomes large and is not returned to the original state and the deviated one of the flat cables 103 and 104 is buckled.

SUMMARY OF THE INVENTION

According to the invention, in a rotary connector of the reverse type in which a plurality of flat cables are reversely wound halfway in a space, at least one of the overlapping faces of the flat cables is subjected to a surface roughening process. With such construction, even if the overlapped flat cables are deviated in the winding direction when a movable housing is rotated, the frictional resistance of the overlapped faces of the flat cables is reduced by the surface roughening process, the flat cables are smoothly slid and the buckling is prevented.

A rotary connector of the invention has a pair of housings which are rotatably connected to each other via an annular space and a plurality of flat cables which are wound in the space in a state where the winding direction is reversed halfway and have ends fixed to the housings. At least one of the overlapping faces of the flat cables is subjected to a surface roughening process. The average surface roughness of the roughened face is set to 0.03 $\mu$m or larger.

In the surface roughening process for the flat cable, means for roughening the surface of the flat cable by a sandblast or a chemical, means for making the surface rough by mixing a filler such as silica powders or the like in a base film of the flat cable, or the like can be used.

The surface roughening process can be performed to both sides of each of the flat cables. The surface roughening process can be also performed to only one side of each of the flat cables and the roughened face and the flat face of adjacent flat cable are overlapped. It is also possible that a flat cable in which the surface roughening process is performed to both sides and a flat cable in which both faces are flat are used and the rough face and the flat face of the flat cables of the two kinds are overlapped.

DETAILED DESCRIPTION OF THE PREFERRED EMBODIMENTS

Figure 1:
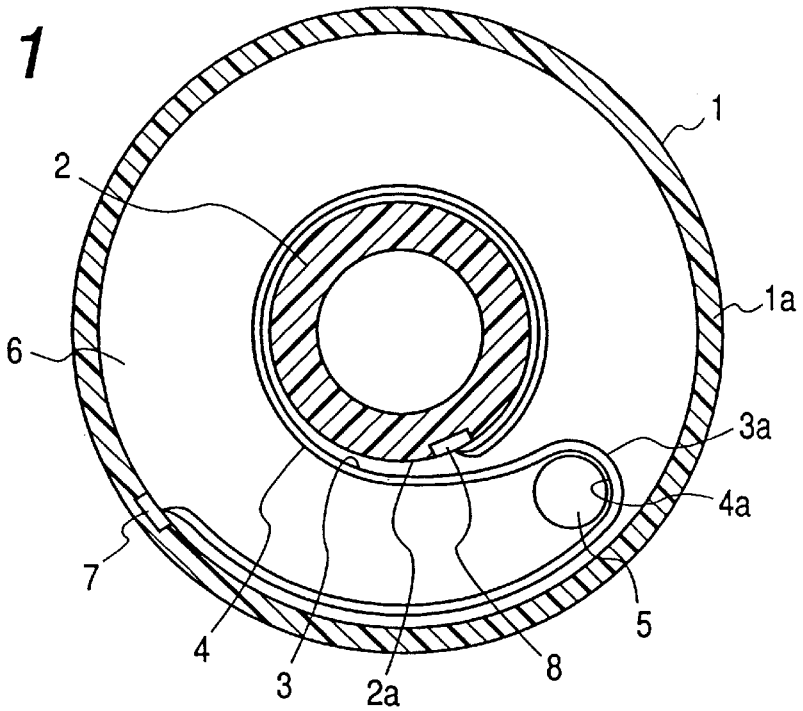
FIG. 1 is a plan view showing a schematic construction of a rotary connector according to an embodiment.
Figure 2:
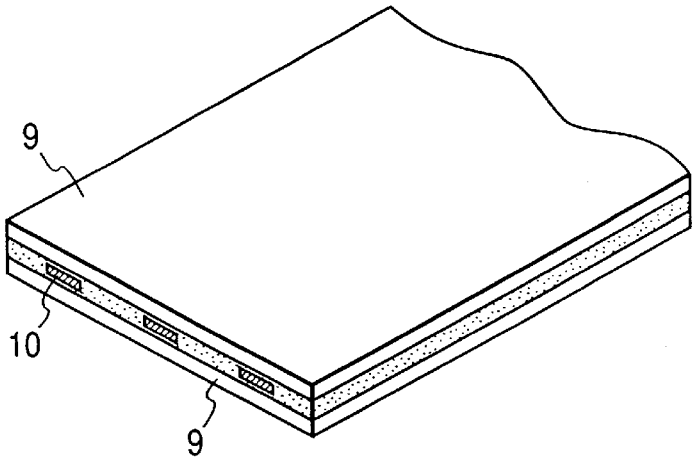
FIG. 2 is a perspective view of a flat cable provided for the rotary connector.
Figure 3:
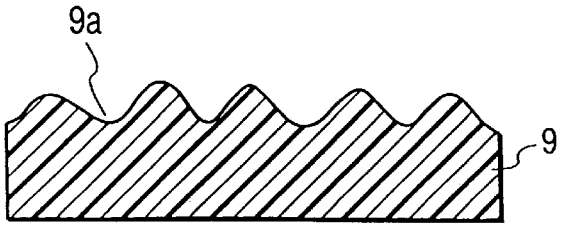
FIG. 3 is an explanatory diagram showing a rough face of the flat cable.
Figure 4:
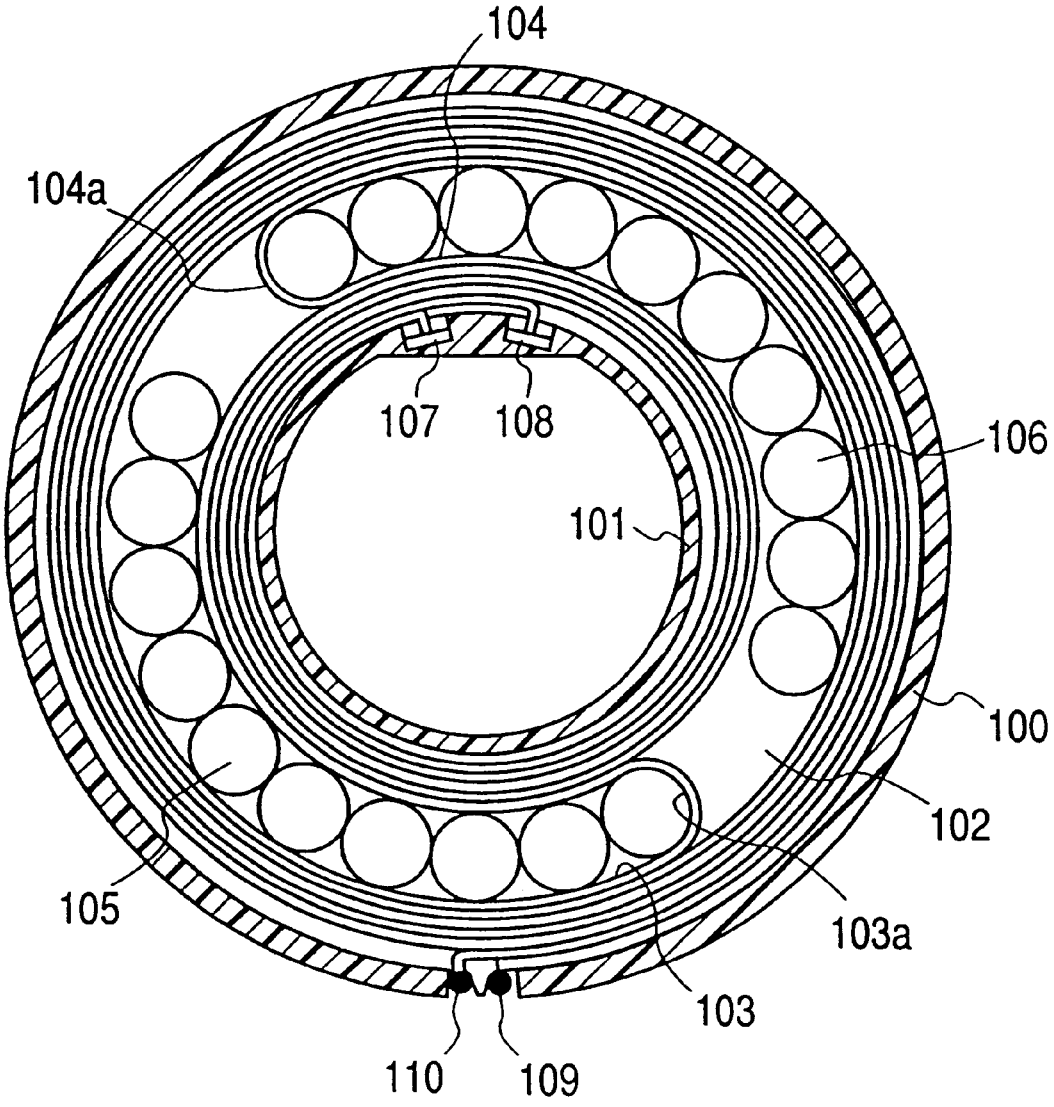
FIG. 4 PRIOR ART
FIG. 4 is a plan view of a conventional rotary connector.

Embodiments will be described with reference to the drawings. FIG. 1 is a plan view showing a schematic construction of a rotary connector. FIG. 2 is a perspective view of a flat cable provided for the rotary connector. FIG. 3 is an explanatory diagram showing a rough face of the flat cable.

As shown in FIG. 1, the rotary connector according to the embodiment is, schematically, constructed by a fixed housing 1, a movable housing 2 rotatably attached to the fixed housing 1, first and second flat cables 3 and 4 housed between the housings 1 and 2, and a roller 5 arranged between the housings 1 and 2.

An outer cylindrical wall 1*a* is formed on the fixed housing 1 and an inner cylindrical wall 2*a* is formed on the movable housing 2. The outer cylindrical wall 1*a* and the inner cylindrical wall 2*a* are coaxially arranged and an annular space 6 is defined between the walls 1*a* and 2*a*. A moving member which is omitted in the diagram is arranged in the space 6 and reverse parts 3*a* and 4*a* of the flat cables 3 and 4 are looped about the roller 5 axially supported by the moving member.

The first flat cable 3 and the second flat cable 4 are overlapped, and the outer ends of the flat cables 3 and 4 are gathered at a fixed side joint 7 fixed to the outer cylindrical wall 1*a* and are electrically led to the outside of the fixed housing 1 via the fixed side joint 7. The inner ends of the flat cables 3 and 4 are gathered at a movable side joint 8 fixed to the inner cylindrical wall 2*a* and are electrically led to the outside of the movable housing 2 via the movable side joint 8. The flat cables 3 and 4 are wound in the counterclockwise direction along the outer cylindrical wall 1*a* from the fixed side joint 7 and the winding direction is changed at the reverse parts 3*a* and 4*a* in the middle. After that, the flat cables 3 and 4 are wound in the clockwise direction along the inner cylindrical wall 2*a*, are housed in the space 6 and reach the movable joint 8. That is, from the fixed side joint 7 to the reverse parts 3*a* and 4*a*, the first flat cable 3 is overlapped on the outer side of the second flat cable 4. From the movable side joint 8 to the reverse parts 3*a* and 4*a*, the second flat cable 4 is overlapped on the outer side of the first flat cable 3. Consequently, although the inner end of the first flat cable 3 is led from the movable side joint 8 and is directly wound around the inner cylindrical wall 2*a*, the inner end of the second flat cable 4 is led from the movable side joint 8 and is wound around outside the first flat cable 3.

As shown in FIG. 2, the first flat cable 3 is a band-shaped member in which a plurality of conductors 10 made of copper or the like are laminated between a pair of base films 9, 9 made by insulating tapes of PET or the like. The surface roughening process is performed to only the surface of one of the base films 9. The surface roughening process is performed by, for example, making the surface of the base film 9 a rough face (coarse face) 9*a* by a sandblast or a chemical process or by mixing a filler such as silica powders in the base film 9 to make the surface of the base film 9 a rough face 9*a* (refer to FIG. 3). The surface roughness of the rough face 9*a* is set so that a central line average roughness Ra specified in JIS B 0601 is 0.03 $\mu$m or larger, preferably, 0.10 to 0.50 $\mu$m. On the contrary, the surface of the other base film 9 to which the surface roughening process is not performed is flat. As for the surface roughness of the flat face, the central line average roughness Ra is 0.02 $\mu$m or less. The second flat cable 4 is similarly constructed. The first flat cable 3 and the second flat cable 4 are overlapped so that the self rough face 9*a* comes into contact with the flat face of the other cable.

The operation of the rotary connector according to the embodiment will be described. In this case, the fixed housing 1 is fixed to a stator member of a steering system and an external connector (not shown) on a vehicle body side is connected to the fixed side joint 7. The movable housing 2 is connected to a steering wheel as a rotor member of the steering system and the external connector (not shown) on the steering wheel side is connected to the movable side joint 8.

In operation, when the steering wheel is rotated in the clockwise or counterclockwise direction, the rotational force is transmitted to the movable housing 2 and the movable housing 2 is rotated in the clockwise or counterclockwise direction. For example, when the movable housing 2 is rotated in the clockwise direction from the neutral position of the steering wheel, the reverse parts 3*a* and 4*a* of the first and second flat cables 3 and 4 are moved in the clockwise direction by a rotation amount smaller than that of the movable housing 2 and the roller 5 is moved in the clockwise direction so as to follow the reverse parts 3*a* and 4*a*. As a result, the flat cables 3 and 4 of the length which is about double as that of the movement amount are fed from the outer cylindrical wall 1*a* and are wound around the inner cylindrical wall 2*a* (winding state). On the contrary, when the movable housing 2 is rotated in the counterclockwise direction from the neutral state of the steering wheel, the reverse parts 3*a* and 4*a* of the flat cables 3 and 4 are moved in the counterclockwise direction by a rotation amount smaller than that of the movable housing 2 and the roller 5 is moved in the counterclockwise direction so as to follow the reverse parts 3*a* and 4*a*. As a result, the flat cables 3 and 4 of the length about double as that of the movement amount are fed from the inner cylindrical wall 2*a* side and are rewound on the outer cylindrical wall 1*a* (rewinding state).

During the operation, since the diameters of the wound flat cables 3 and 4 on the inner cylindrical wall 2*a* are slightly different, the winding amounts of the flat cables 3 and 4 on the inner cylindrical wall 2*a* or the rewinding amounts from the inner cylindrical wall 2*a* are not the same. Consequently, a deviation occurs on the contact faces of the flat cables 3 and 4. In this case, since the rough faces 9*a* of the flat cables 3 and 4 are in contact with the flat faces of the other cables 3 and 4, the frictional resistance of the flat cables 3 and 4 is extremely small, the flat cables 3 and 4 slide smoothly, and the buckling is prevented.

Although the case where only one face of each of the first and second flat cables 3 and 4 is the rough face 9*a* and the self rough face 9*a* comes into contact with the flat face of the other cable has been described in the embodiment, it is also possible that both faces of the first flat cable 3 are the rough faces 9*a* and both faces of the second flat cable 4 are flat faces, and on the contrary, both faces of the first flat cable 3 are flat faces and both faces of the second flat cable 4 are rough faces 9*a*. In this case, when the rough face 9*a* of one of the flat cables comes into contact with the flat face of the other flat cable, effects similar to those of the above embodiment can be obviously obtained. Moreover, since the sides of the faces of each of the flat cables 3 and 4 do not have to be considered, an additional effect such that an assembly work is facilitated is obtained.

Both faces of each of the first and second flat cables 3 and 4 can be made rough faces 9*a*. In this case, there is an additional effect that the flat cables 3 and 4 are commonly used.

Although the case where the number of flat cables is two, that is, N=2 has been described in the foregoing embodiments, the invention can be similarly applied to cases where the number of the flat cables is 3, 4, 5, . . . (N=3, 4, 5 . . . ). In the case where the N is 3 or larger odd number, when a flat cable whose both faces are flat is wound first on the inner cylindrical part and a flat cable whose both faces are rough and a flat cable having flat and rough faces are alternately wound, there is a contacting part in the flat cables having the flat faces. Even in this case, since the contacting part of the flat faces is only a part of the whole length, although the effect of the invention is reduced to some extent, it is still effective as compared with a case where flat cables whose both faces are flat are wound.

The present invention is embodied in the modes as mentioned above and has effects as described hereinbelow.

The rotary connector comprises a pair of housings rotatably connected via an annular space and a plurality of flat cables which are wound in the space in a state where the winding direction is reversed halfway and ends of the flat cables are fixed to the housings. When the surface roughening process is performed to at least one of the contacting faces of the flat cables and the average surface roughness of the roughened face is set to 0.03 $\mu$m or larger, even if the overlapping flat cables are deviated in the winding direction when the movable housing is rotated, since the frictional resistance of the contacting faces of the flat cables is reduced by the surface roughening process, the buckling of the flat cables can be prevented.

I claim:

1. A rotary connector comprising a pair of housings rotatably connected via an annular space and a plurality of flat cables which are wound in said space in a state where the winding direction is reversed along the length of the cables and each of said cable has ends fixed to said housings, wherein a surface roughening process is performed on at least one contacting face of at least one of said flat cables and the average surface roughness Ra of the roughened contacting face is 0.03 $\mu$m or larger.

2. The rotary connector according to claim 1, wherein said surface roughening process is performed to one face of each of said flat cables and the other face is made a flat face, and the roughened face of the flat cable comes into contact with the flat face of the adjacent flat cable.

3. The rotary connector according to claim 1, wherein a flat cable both of whose faces are subjected to said surface roughening process and a flat cable whose both faces are made flat faces are used as said flat cables and the rough face of one of the flat cables comes into contact with the flat face of the adjacent flat cable.

4. The rotary connector according to claim 1, wherein said surface roughening process is performed to both faces of each of said flat cables.

5. The rotary connector according to claim 1, wherein a filler is mixed in the part of the flat cable to which said surface roughening process is performed.

6. The rotary connector according to claim 2, wherein a filler is mixed in the part of the flat cable to which said surface roughening process is performed.

7. The rotary connector according to claim 3, wherein a filler is mixed in the part of the flat cable to which said surface roughening process is performed.

8. The rotary connector according to claim 4, wherein a filler is mixed in the part of the flat cable to which said surface roughening process is performed.

9. The rotary connector according to claim 1, wherein both ends of each of said plurality of flat cables are gathered and fixed at one position in a respective one of said housings.

10. The rotary connector according to claim 2, wherein both ends of each of said plurality of flat cables are gathered and fixed at one position in a respective one of said housings.

11. The rotary connector according to claim 3, wherein both ends of each of said plurality of flat cables are gathered and fixed at one position in a respective one of said housings.

12. The rotary connector according to claim 4, wherein both ends of each of said plurality of flat cables are gathered and fixed at one position in a respective one of said housings.

13. A rotary connector comprising a pair of housings rotatably connected via an annular space and two flat cables which are wound in said space in a state where the winding direction is reversed along the length of the cables and the ends of the flat cables are fixed to said pair of housings, wherein a surface roughening process is performed on at least one contacting face of at least one of said flat cables and the average surface roughness Ra of the roughened face is set to 0.03 $\mu$m or larger.

* * * * *

UNITED STATES PATENT AND TRADEMARK OFFICE

CERTIFICATE OF CORRECTION

PATENT NO. : 5,980,287

DATED : November 9, 1999

INVENTOR(S) : Kunihiko Sasaki

It is certified that error appears in the above-identified patent and that said Letters Patent is hereby corrected as shown below:

In claim 1, line 5, please change "cable" to --cables--.

Signed and Sealed this

Fourteenth Day of November, 2000

*Attest:*

Q. TODD DICKINSON

*Attesting Officer*

*Director of Patents and Trademarks*